United States Patent [19]

Meyer

[11] Patent Number: 4,951,951

[45] Date of Patent: Aug. 28, 1990

[54] TURF FIXING PUTTER

[76] Inventor: Herman R. Meyer, Box 119, Green Valley, Ariz. 85622

[21] Appl. No.: 315,493

[22] Filed: Feb. 27, 1989

Related U.S. Application Data

[63] Continuation-in-part of Ser. No. 185,842, Apr. 25, 1988, abandoned.

[51] Int. Cl.[5] ..... A63B 53/04; A63B 57/00

[52] U.S. Cl. ..... 273/162 F; 273/162 R; 273/167 A; 273/168; 273/167 D; 273/32 B; 172/378

[58] Field of Search ..... 273/162 A–162 F, 273/162 R, 32 R, 32 B, 32 F, 32 G, 167 D, 168, 167 A; D21/214–219

[56] References Cited

U.S. PATENT DOCUMENTS

D. 217,483 5/1970 Jackson ..... D34/5

FOREIGN PATENT DOCUMENTS 502667 5/1951 Belgium ..... 172/375

*Primary Examiner*—Edward M. Coven
*Assistant Examiner*—Valerie Szczepanik
*Attorney, Agent, or Firm*—LaValle D. Pak

[57] ABSTRACT

An improved golf club having a turf repairing fork formed in the heel of the head thereof enabling the golfer to remain erect while repairing the turf. The golfer saves effort and time by forcing the fork down into the grass mound left by the impact of a golf ball on a putting green, sufficiently far enough so that it extends under the depressed turf of the ball mark. By rocking the putter shaft slightly forward the fork will lift the depressed turf and by rocking the putter shaft slightly backwards, the grass mound can be pulled back to its original position. The fork of the putter can also be used to clean foreign matter from the soles and spikes of a golfer's shoes.

7 Claims, 1 Drawing Sheet

FIG. 1
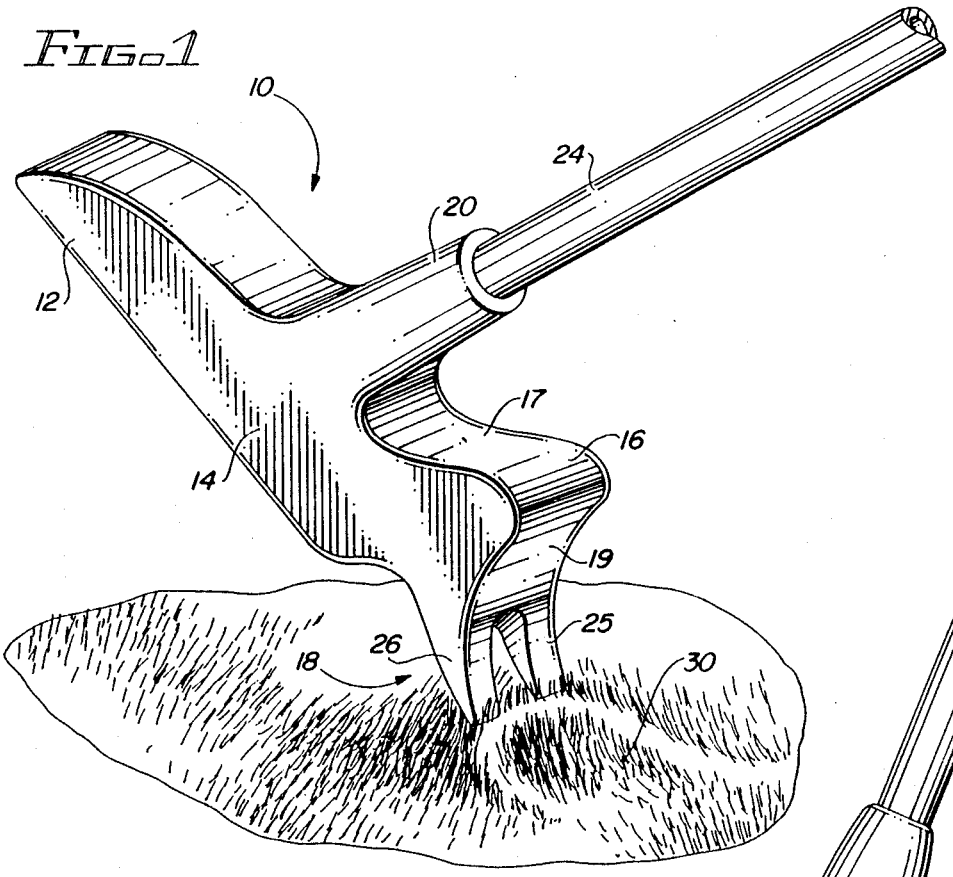
FIG. 2
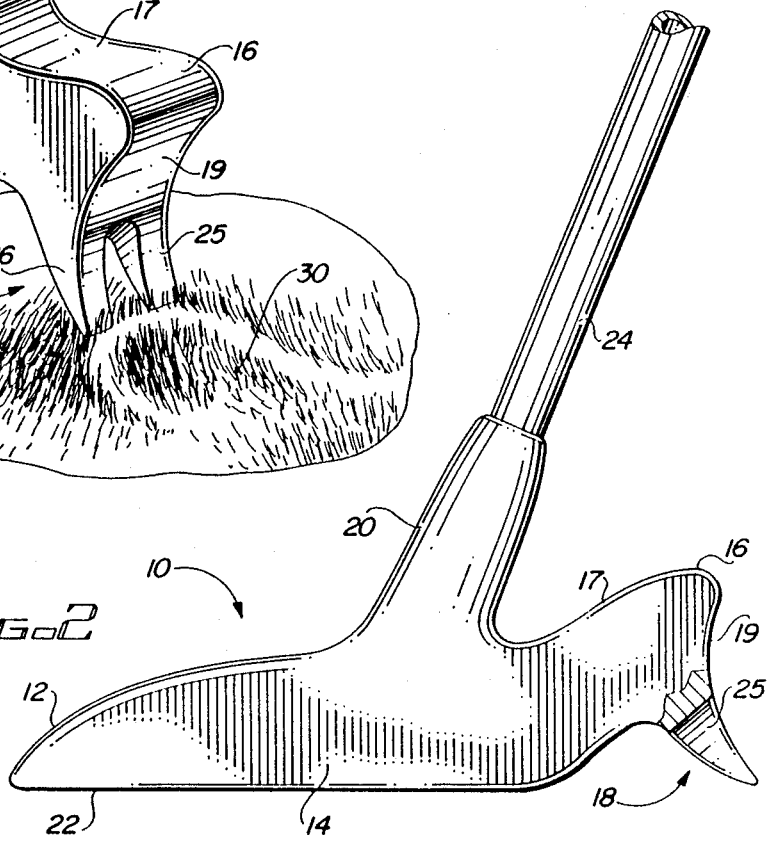
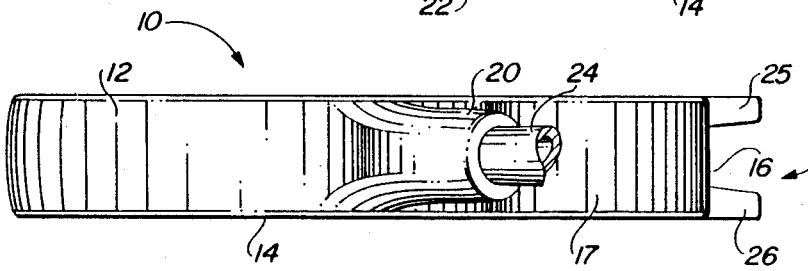
FIG. 3
FIG. 4
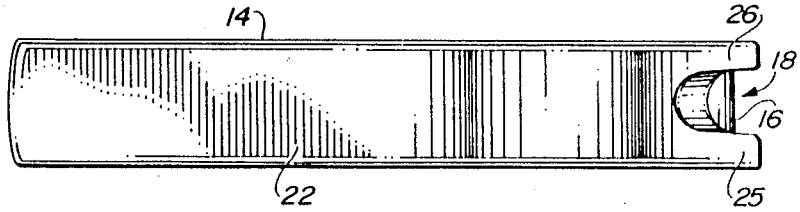

TURF FIXING PUTTER

RELATED APPLICATION

This application is a continuation-in-part of application Ser. No. 07/185,842, filed Apr. 25, 1988, now abandoned.

BACKGROUND

This invention relates to golf clubs, especially to a putter which enables a golfer to repair ground surfaces related to golf, which ground surfaces are herein referred to as turf, while the golfer remains erect. This makes it unnecessary for the golfer to have to carry one more golfing tool, that is any tool the golfer may carry to repair the turf. This improved putter may also be used to perform several other functions.

DESCRIPTION OF PRIOR ART

Many, if not most golfers, carry a pocket sized golfing tool to be used for repairing turf. Heretofore, a variety of golfing tools have been proposed and implemented for this purpose.

The best known of such tools are carried and kept in the golfer's pocket, so that the golfer must take time to retrieve and return the tool for each use. Also, the golfer must bend down to perform this desired function when using known tools. As such bending down may be difficult, many damaged turf areas are not repaired.

Most golfers, therefore, would find it desirable to have a tool to repair turf while remaining erect, which eliminates the need for the golfer to remember and carry one more tool. My invention would make the game of golf a little easier and quicker, and more damaged turf areas would be repaired.

OBJECT AND ADVANTAGES

It is an object of my invention to provide a tool that makes the game of golf a little easier and quicker by enabling a golfer to repair turf without having to bend over. A further object of my invention is to provide a golf club that can be used to repair turf without having to retrieve and return a separate prior art tool from the golfer's pocket. An additional object is to provide a golf club which permits a golfer to remain erect while cleaning dirt, grass, etc. from the soles and spikes of his golf shoes. Herein dirt and grass, etc. will be referred to as foreign matter.

Further objects and advantages of the invention will be apparent from a consideration of the ensuing description and the accompanying drawings.

BRIEF DESCRIPTION OF THE DRAWINGS

The invention is illustrated by the not limiting drawing figures, wherein

FIG. 1 shows a perspective view of a preferred embodiment of the present invention in its practical application;

FIG. 2 shows a front elevation view of the device, shown in FIG. 1;

FIG. 3 shows a top view of the device in FIG. 1; and

FIG. 4 shows a bottom view of the device in FIG. 1.

DETAILED DESCRIPTION

Referring now to the drawings, FIG. 1 shows a unitary tool according to the preferred embodiment of the invention. The tool comprises a putter having a head 10 and a shaft 24. The head 10 has a face 14 which is smooth and flat, which face 14 is at a right angle to the sole 22 of the head 10. The sole 22 has a flat horizontal bottom, enabling the shaft 24 to be at substantially a right angle to the slope of the turf upon which the putter head 10 is resting.

The putter head 10 extends forward to form the toe 12 which may slope upward from the sole 22 and downward from the neck 20. Said toe 12 can have the same width as the face 14.

The putter head 10 extends to the rear to form a heel 16 and a fork 18. The top, or summit, of the heel 16 extends to the rear from the neck 20 with a sloping upper surface 17. The heel 16 has a concave surface 19 sloping downward toward a fork 18. Said heel can have the same width as the face 14.

The fork 18 consists of two spaced-apart prongs 25 and 26. The fork 18 extends downwards, curving slightly away from the sole 22 and extending to a sufficient point enabling the function of the invention. The lower surface of the prongs 25 and 26 is slightly convex, and the upper surface is slightly concave. The said curving of the fork 18 results in the prongs 25 and 26 of the fork 18 being off the ground when the face 14 is being used.

The neck 20 extends upward and angles slightly to the rear from the top of the putter head 10. The neck 20 is positioned a little off center to the rear, above the face 14. The neck 20 has provision for securing the same to a standard putter shaft 24 which has a grip (not shown) at the end thereof.

OPERATION

The putter of FIG. 1 will perform a variety of functions, including putting, turf repairing, golf shoe sole and spike cleaning, etc., but most users will find it more useful for putting and repairing turf. To use the turf repairing portion of the putter is very simple and may be quickly accomplished. The fork 18 is positioned above the ball mark 30 on the green; so with a downward motion, the prongs 25 and 26 of the fork 18 are forced into the turf in or around the ball mark 30. This is shown in FIG. 2. This is done by holding onto the grip of the putter, so the shaft 24 of the putter is downward at about a forty-five degree (45°) angle, so the putter head 10 is above the ball mark 30. Then with a downward push the prongs of the fork 18 will penetrate the turf in the desired spot in or around the ball mark 30. Once the prongs 25 and 26 of the fork 18 reach the desired depth, said depth being slightly below the bottom of the ball mark 30, the user can then rock the putter forward so the shaft 24 is perpendicular to the turf. This action will raise the depressed turf of the ball mark 30 slightly above the original horizontal line of the turf. The the user can lift and rock backward the putter, so the shaft 24 is back at the aforementioned forty-five degree (45°) angle and the putter head 10 is disengaged from the turf. The user can then step on the mound created. This will ensure the turf returns to its original position.

To clean foreign matter from a golfer's shoes, the user of the golf club can remain erect and perform the operation with ease. Again, by holding the grip so the shaft 24 is in a perpendicular position, the user can point the heel 16 toward the intended golf shoe to be cleaned. The fork 18 tips or prongs 25 and 26 are placed against the sole of the golf shoe and with an up and down motion, foreign matter can be scraped from the golfer's shoes.

The width of the space between the prongs 25 and 26 and the length of that space is selected to allow spikes on the bottom of a golf shoe to pass easily between the prongs during such a cleaning operation.

While the above description contains a specific example, this is not to be construed as a limitation on the scope of the invention, but merely as an example of a preferred embodiment thereof. Those skilled in the art will envision many other possible variations that are within its scope. Accordingly, the scope of the invention is to be limited only by the appended claims.

I claim:

1. A golf club head having a main body portion with a shaft securing neck, a toe, and a face for contact with a golf ball, said golf club head including in combination:

a heel portion extending rearwardly and upwardly from said main body portion to a summit and then rearwardly and downwardly to form a forked projection, said forked projection having at least two spaced-apart prongs terminating in a plane located above the plane of the bottom of said main body portion, said prongs having an upper concave surface to penetrate and manipulate turf under the control of the movement of a shaft secured to the neck of said golf club head.

2. The combination according to claim 1 wherein said prongs are spaced apart a predetermined distance to form an opening therebetween, said predetermined distance and the length of said prongs being selected to permit the spike in the sole of a golf shoe to pass therebetween.

3. The combination according to claim 1 wherein the upper surface of each of said prongs is a slightly concave configuration and the lower surface thereof is a slightly convex configuration; and each of said prongs is tapered and terminates at a tip, with the narrowest portion located at the tip thereof.

4. The combination according to claim 3 wherein said main body portion, said heel portion, and said projection are formed as a single integral part.

5. The combination according to claim 4 wherein said golf club head is a putter head.

6. The combination according to claim 1 wherein said main body portion, said heel portion, and said projection are formed as a single integral part.

7. The combination according to claim 6 wherein said golf club head is a putter head.

* * * * *